US006378831B1

(12) United States Patent
Copeland, Jr.

(10) Patent No.: US 6,378,831 B1
(45) Date of Patent: Apr. 30, 2002

(54) AIR-GUARD CORNER AND EDGE PROTECTOR

(76) Inventor: John R Copeland, Jr., 667 Partridge La., Prattville, AL (US) 36067

( * ) Notice: Subject to any disclaimer, the term of this patent is extended or adjusted under 35 U.S.C. 154(b) by 0 days.

(21) Appl. No.: 09/568,886

(22) Filed: May 11, 2000

(51) Int. Cl.[7] ..... A47B 17/00; A47B 95/00
(52) U.S. Cl. ..... 248/345.1; 108/27
(58) Field of Search ..... 248/345.1, 615; 108/27; 52/716.3, 716.4

(56) References Cited

U.S. PATENT DOCUMENTS

| | | | | | |
|---|---|---|---|---|---|
| 3,281,185 | A | * | 10/1966 | Albinson et al. | 297/452.14 |
| 3,960,354 | A | | 6/1976 | Simikoski | |
| 4,117,782 | A | * | 10/1978 | Cahill | 108/27 |
| 4,153,230 | A | | 5/1979 | Giacin | |
| 4,503,780 | A | * | 3/1985 | Apissomian | 108/27 |
| 4,582,739 | A | | 4/1986 | Givens | |
| 4,817,902 | A | | 4/1989 | Mason | |
| 4,877,673 | A | * | 10/1989 | Eckel et al. | 428/172 |
| 4,988,083 | A | * | 1/1991 | Bradley | 267/140 |
| 5,149,575 | A | * | 9/1992 | Soifer | 428/188 |
| 5,437,071 | A | * | 8/1995 | Feigenbaum | 5/663 |
| 5,496,609 | A | * | 3/1996 | Michelstein | 428/71 |
| 5,527,097 | A | * | 6/1996 | Martin | 297/463.1 |
| 5,639,072 | A | | 6/1997 | McCall | |
| 5,809,901 | A | * | 9/1998 | Gutzmer | 108/27 |
| 6,019,336 | A | * | 2/2000 | Havens | 248/345.1 |
| 6,036,155 | A | * | 3/2000 | Tsui | 248/345.1 |
| 6,103,335 | A | * | 8/2000 | Zoller et al. | 428/116 |

FOREIGN PATENT DOCUMENTS

| | | | |
|---|---|---|---|
| FR | 2602653 | * | 7/1986 |

* cited by examiner

*Primary Examiner*—Anita King
(74) *Attorney, Agent, or Firm*—Michael I Kroll

(57) ABSTRACT

A device is provided for protecting children from injury due to impacts with hard edges and corners of tables and other furniture. The Air-guard Corner and Edge Protector has a dual deceleration system, and is a one-piece, pneumatic, shock-absorbing elastomer table corner and edge guard with multiple air chambers separated by elastomer partitions. It has bleed holes in the bottom of each chamber for further shock absorption through pneumatically controlled collapsibility. In its pre-impact state, the chambers are filled with air. As the head of the child begins to load the device, two energy absorption mechanisms are in effect. The first is the compression of the elastomeric material in the outer wall of the device and the partitions. Second, the outer wall is displaced into the chamber. Air is forced from the bleed hole as the chamber collapses, with the bleed hole being sized such that an appropriate rate of collapse is achieved. This controlled collapsibility improves the energy absorbing capabilities of the device above that of a similarly sized solid compressible material in that the pulse of the deceleration event is increased.

Once the head displacement has stopped, the head will rebound less due the previous collapse of the chamber, whether a partial collapse or otherwise. The return of the displaced outer wall to its pre-impact position is slowed by the relatively slow rate at which air returns to the chamber through the bleed hole.

26 Claims, 8 Drawing Sheets

AIR-GUARD CORNER AND EDGE PROTECTOR

BACKGROUND OF THE INVENTION

1. Field of the Invention

The present invention relates generally to safety devices and, more specifically, to furniture corner and edge protectors. Typical devices in this field made of some form of elastomer material in a variety of configurations. Some protect corners only while others offer complete protection for the entire top surface edge of the furniture item. Some protect the upper edge only, while others protect both upper and lower edges for those furniture items with overhanging top surfaces. Some protective edge covers are produced in continuous strip form with open ends that are then cut to size in the field with the ends butted together. Others are manufactured as a single closed molded unit that is meant to fit one size only. All prior art utilizes elastomer material shock absorbing characteristics to provide corner and edge protection. While this form of protection is effective in reducing impact injuries, it is inherently limited by the uniform highly elastic characteristics of the elastomer material. This means that impact energy which exceeds the absorbing capacity of the protective elastomer material will cause the remaining impact to transfer its energy to the highly inelastic material of the object beneath causing rapid deceleration with its attendant internal injury potential.

The present invention, the Air-Guard Corner and Edge Protector, overcomes this dangerous deficiency by providing a dual deceleration system. It is a one-piece, pneumatic, shock-absorbing elastomer table corner and edge guard with multiple air chambers separated by elastomer partitions and having bleed holes in the bottom of each chamber for further shock absorption through pneumatically controlled collapsibility.

In its pre-impact state, the chambers are filled with air. As the head of the child begins to load the device, two energy absorption mechanisms are in effect. The first is the compression of the elastomeric material in the outer wall of the device and the partitions. Kinetic energy is converted to potential energy as such material is compressed. Second, the outer wall is displaced into the chamber. Air is forced from the bleed hole as the chamber collapses, with the bleed hole being sized such that an appropriate rate of collapse is achieved. This controlled collapsibility improves the energy absorbing capabilities of the device above that of a similarly sized solid compressible material in that the pulse of the deceleration event is increased.

Furthermore, in the event of a total collapse of the chamber, the compression of the outer wall material will resume as the outer wall continues to be loaded while against the portion of the device adjacent the table edge.

Once the head displacement has stopped, the head will rebound less due to the previous collapse of the chamber, whether a partial collapse or otherwise. Although the spring characteristics of the compressed outer wall material will cause some rebound, the return of the displaced outer wall to its pre-impact position is slowed by the relatively slow rate at which air returns to the chamber through the bleed hole. Any lowering of the rebound rate is beneficial to the child with regard to the potential for head injury.

2. Description of the Prior Art

There are other edge protective devices designed for impact attenuation. Typical of these is U.S. Pat. No. 3,960,354 issued to Wayne Simikoski on Jun. 1, 1976.

Another patent was issued to Terry L Glacin on May 8, 1979 as U.S. Pat. No. 4,153,230. Yet another U.S. Pat. No. 4,582,739 was issued to Rosemarie Givens on Apr. 15, 1986 and still yet another was issued on Apr. 4, 1989 to Donald R. Mason as U.S. Pat. No. 4,817,902.

Another patent was issued to Gary W. McCall on Jun. 17, 1997 as Pat. No. 5,639,072.

U.S. Pat. No. 5.639,072

Inventor: Gary W. McCall

Issued: Jun. 17, 1997

The present invention relates to a bumper that can be releasably attached to planar edges of furniture such as edges of a cocktail table, end table, library table or the like. The bumper comprises a cushion circumscribed by an appropriately seemed outer cover, the bumper being in the form of a modified cylinder of length L. Preferably, the bumper is of either of a solid or hollow form. In one aspect, the solid cylindrical form of the bumper is modified by providing a minor sector cut-out centered along its axis of formation and extending along its length L. The cut-out defines an included angle of 90 degrees. Hence, the major sector circumference of bumper that remains, defines a circumferential angle of 270 degrees as well as provided a pair of interior, normal faces or walls. In another aspect, the cylindrical form is hollow and modified to provide a longitudinal slot along its length. Attachment of the bumper relative to the edges of the table is provided by a series of selective releasable Velcro-type fasteners. Each fastener comprises a planar hook section in which the broad surface opposite the hook surface is attached to either the table edge or to the wall surface or surfaces of the bumper, and a planar loop section in which the broad surface opposite the loop surface is attached to the other element of each fastener.

U.S. Pat. No. 3,960,354

Inventor: Wayne L. Simikoski

Issued: Jun. 1, 1976

A corner protector adapted to extend over a corner portion of an object of furniture, such as a table, for protecting against injuries to small children or other people falling accidentally against the corner portion, includes an upper plate composed of impact-absorbing material and a depending skirt portion composed of impact-absorbing material for overlying the respective upper and vertical surfaces of the corner portion of the object. The skirt portion includes a pair of side walls and a smoothly contoured front wall joining the pair of side walls, the front wall being configured to be disposed substantially rearwardly of a imaginary intersection of the planes of the side walls. The protector is attached releasably to the object of furniture by a suitable adhesive and by elastic bands stretched between adjacent corner protectors. A pair of elongated blocks may be fixed to the plate and extend along and engage the inside surfaces of the side walls to serve as spacers. Different pairs of blocks are provided, each pair of blocks being configured differently, to accommodate different shapes of corner portions, such as square corners, rounded corners or corners of hexagonal tables or the like.

U.S. Pat. No. 4,153,230

Inventor: Terry L. Glacin

Issued: May 8, 1979

A safety bumper for furniture, in order to protect young children, as well as old or handicapped persons, from becoming injured if falling upon sharp edges of furniture; the device consisting generally of a stretchable rubber bead that snaps-fits around the periphery of any shaped furniture top edge, and which includes horizontal flaps for extending over the top, and a vertical flap for extending adjacent the side of the furniture, the bead at its corners additionally including a spherical shaped protrusion, for additional impact shock absorption.

U.S. Pat. No. 4,582,739

Inventor: Rosemarie Givens

Issued: Apr. 15, 1986

A removable protective impact bumper that encloses the edges and corners of furniture to, in part, prevent injuries to children that may result from falling against the edges or corners. The bumper is intended to be reusable and to be installed and removed without damage to furniture. The bumper includes a double slotted, elongated, extruded cushion made of a flexible, resilient, nontoxic, fire retardant foam plastic material such as polyurethane, in various colors and patterns such as woodgrain to compliment home decor. To tightly secure the bumper to furniture, three reusable adhesive strips of a type that will not be damaging to furniture extend along the face surfaces of a groove, with a release paper to protect adhesive prior to use. A belt with a fastener runs along the inside surface of an outer groove and is tightly secured around such furniture. The bumper can be cut to fit any size table with the ends thereof in end abutting relation. The outer slot closes under compression and thus completely conceals the belt and fastener. If the bumper is to be used on furniture where the complete perimeter of the furniture is not accessible, such as counters, the belt may be eliminated.

U.S. Pat. No. 4,817,902

Inventor: Donald R. Mason

Issued: Apr. 4, 1989

A corner protector assembly for the cushioned covering of corners of tables of the like, so as to prevent harmful collisions between young children and the furniture on which the protector assembly is attached. The protector assembly comprises a resilient inner core which is "corner shaped" and matable to a corner of furniture. An outer cover, having an elasticized hem, is adapted to fit like a mitt over the inner core. The outer cover also has a pair of tie strings which secure the cover over the inner core and secure both to the leg at the corner of the table. The cover is readily removable from the inner core and the assembly is easily removable and reattachable.

While these edge and corner protectors may be suitable for the purposes for which they were designed, they would not be as suitable for the purposes of the present invention, as hereinafter described.

SUMMARY OF THE PRESENT INVENTION

A primary object of the present invention is to overcome the shortcomings of the prior art.

An additional object of the present invention is to provide a corner and edge protector that will offer greater protection from injury than is currently available in similar products.

Another object of the present invention is to provide a single, continuous corner and edge protector for a fit that will assure constant protection that can not loosen or be dislodged.

Yet another object of the present invention is to provide a single, continuous corner and edge protector that can stretch somewhat to accommodate a limited range of commercially available size tabletops and that will be available in a range of sizes to accommodate the entire range of commercially available table top sizes.

Still yet another object of the present invention is to provide a single, continuous corner and edge protector with a large range of colors and styles to suit every taste.

Yet another object of the present invention is to provide a single, continuous corner and edge protector that is economical to manufacture, sell and purchase.

Yet another object of the present invention is to provide a continuous corner and edge protector that includes dual energy absorption mechanisms, including both compressible materials and pneumatically collapsible chambers.

Additional objects of the present invention will appear as the description proceeds.

The present invention overcomes the shortcomings of the prior art by providing, the Air-guard Corner and Edge Protector, with a dual deceleration system. It is a one-piece, pneumatic, shock-absorbing elastomer table corner and edge guard with multiple air chambers separated by elastomer partitions and having bleed holes in the bottom of each chamber for further shock absorption through pneumatically controlled collapsibility.

In its pre-impact state, the chambers are filled with air. As the head of the child begins to load the device, two energy absorption mechanisms are in effect. The first is the compression of the elastomeric material in the outer wall of the device and the partitions. Kinetic energy is converted to potential energy as such material is compressed. Second, the outer wall is displaced into the chamber. Air is forced from the bleed hole as the chamber collapses, with the bleed hole being sized such that an appropriate rate of collapse is achieved. This controlled collapsibility improves the energy absorbing capabilities of the device above that of a similarly sized solid compressible material in that the pulse of the deceleration event is increased.

Furthermore, in the event of a total collapse of the chamber, the compression of the outer wall material will resume as the outer wall continues to be loaded while against the portion of the device adjacent the table edge.

Once the head displacement has stopped, the head will rebound less due to the previous collapse of the chamber, whether a partial collapse or otherwise. Although the spring characteristics of the compressed outer wall material will cause some rebound, the return of the displaced outer wall to its pre-impact position is slowed by the relatively slow rate at which air returns to the chamber through the bleed hole. Any lowering of the rebound rate is beneficial to the child with regard to the potential for head injury.

The Air-Guard Corner and Edge Protector consists of continuous single molded elastomer form with multiple interior air-chambers including four corner air chambers and a specific number of air chambers along the four table edges, the number of which varies with the size of the device. A typical corner cross section profile is thicker than a typical edge chamber cross section profile. A typical chamber length section of the device consists of the air chamber, which is bounded on four sides by a rear wall portion, two common chamber partition walls and the single continuous upper/lower curved wraparound outer wall, with a bleed hole centralized in the bottom of the chamber. Rearwardly extending portions from the rear wall act as the tabletop gripping surfaces and the back of the rear chamber wall bounds the gripping area.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in, a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
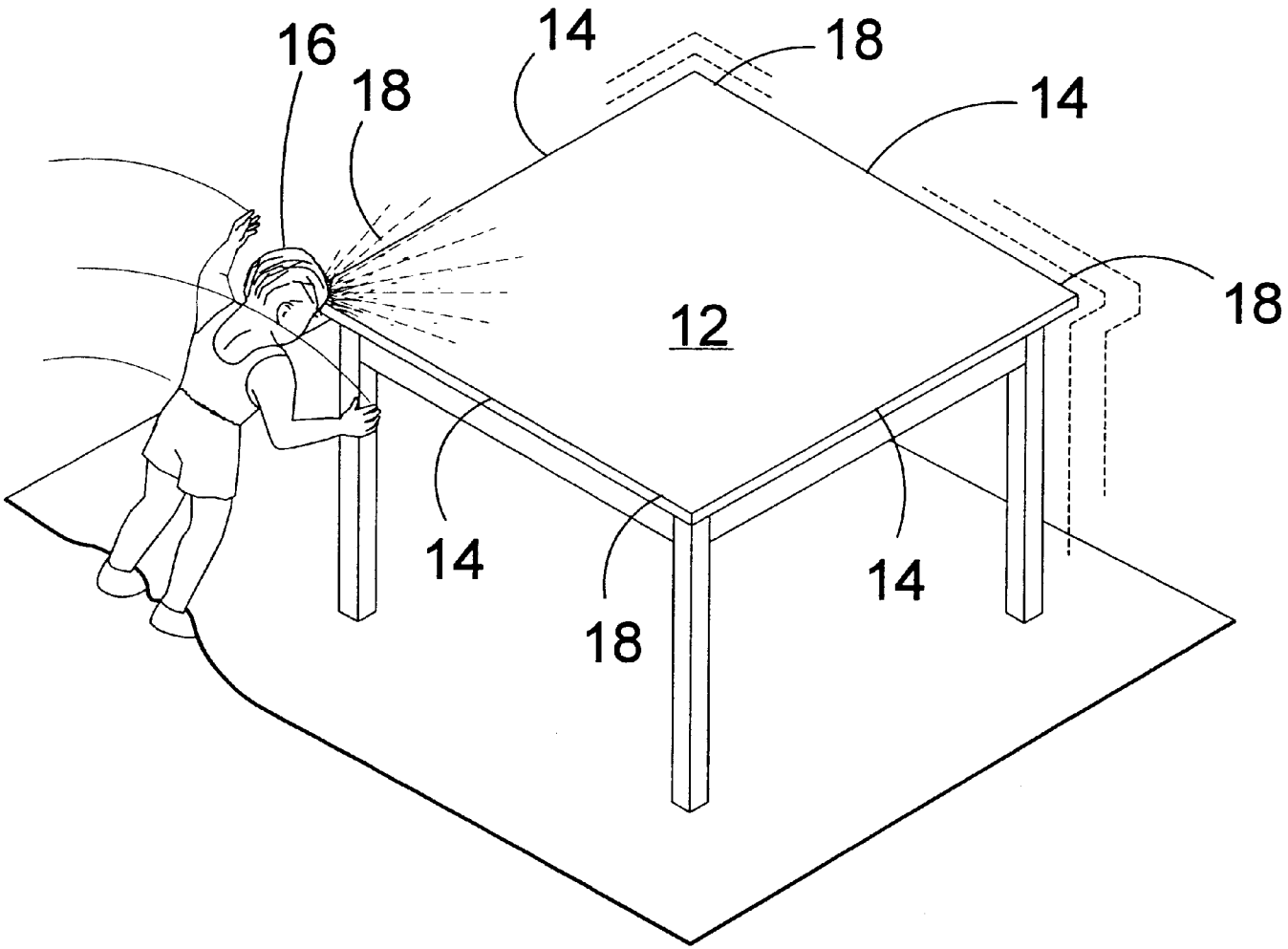
FIG. 1 is a perspective view of a child accidentally encountering an unprotected tabletop corner illustrating the potential for great injury from unprotected sharp edges and corners.

Turning now descriptively to the drawings, in which similar reference characters denote similar elements throughout the several views, the Figures illustrate Air-guard Corner and Edge Protector of the present invention. with regard to the reference numerals used, the following numbering is used throughout the various drawing figures.

10 Air-Guard Corner and Edge Protector

12 table

14 table edge

16 child

18 table corner

30 elongated member

32 outer wall

34 rear portion

36 cavity

38 partition

40 chamber

42 outer wall cavity floor portion

44 bleed hole

46 rear wall

48 rearwardly extending portion

50 first end

52 second end

DETAILED DESCRIPTION OF THE PREFERRED EMBODIMENT

Turning now descriptively to the drawings, in which similar reference characters denote similar elements throughout the several views, FIGS. 1–7 illustrate the Air-guard Corner and Edge Protector of the present invention indicated generally by the numeral 10.

Figure 2:
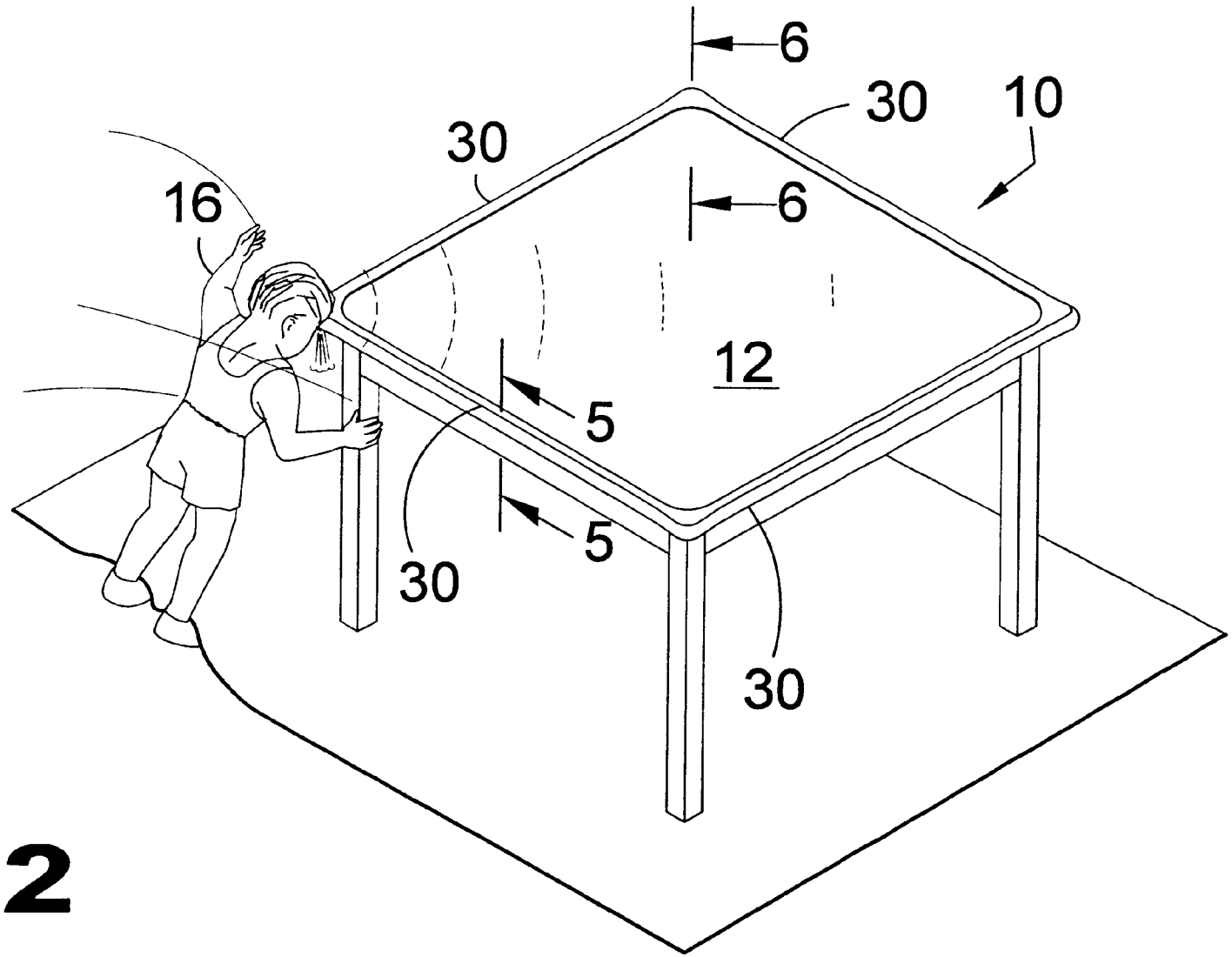
FIG. 2 is a perspective view of a child accidentally encountering a tabletop corner protected by the present invention, the Air-Guard Corner and Edge Protect, illustrating its greatly attenuating effect upon the impact of the child with the table and the virtual elimination of the possibility of serious injury.

The device 10 is shown in FIG. 2. The device 10 is formed from elastomeric materials providing compressibility for energy-absorbing function and a degree of tensibility for flexible fit. The embodiment shown in FIG. 2 is suitable for an ordinary table 12 having four edges 14, the edges 14 often being near head level of a child 16. Although the device 10 can be trimmed and sized in other embodiments to independently fit each corner 18, FIG. 2 shows that this embodiment provides complete coverage of all four table edges 14 and corners 18.

Figure 3:
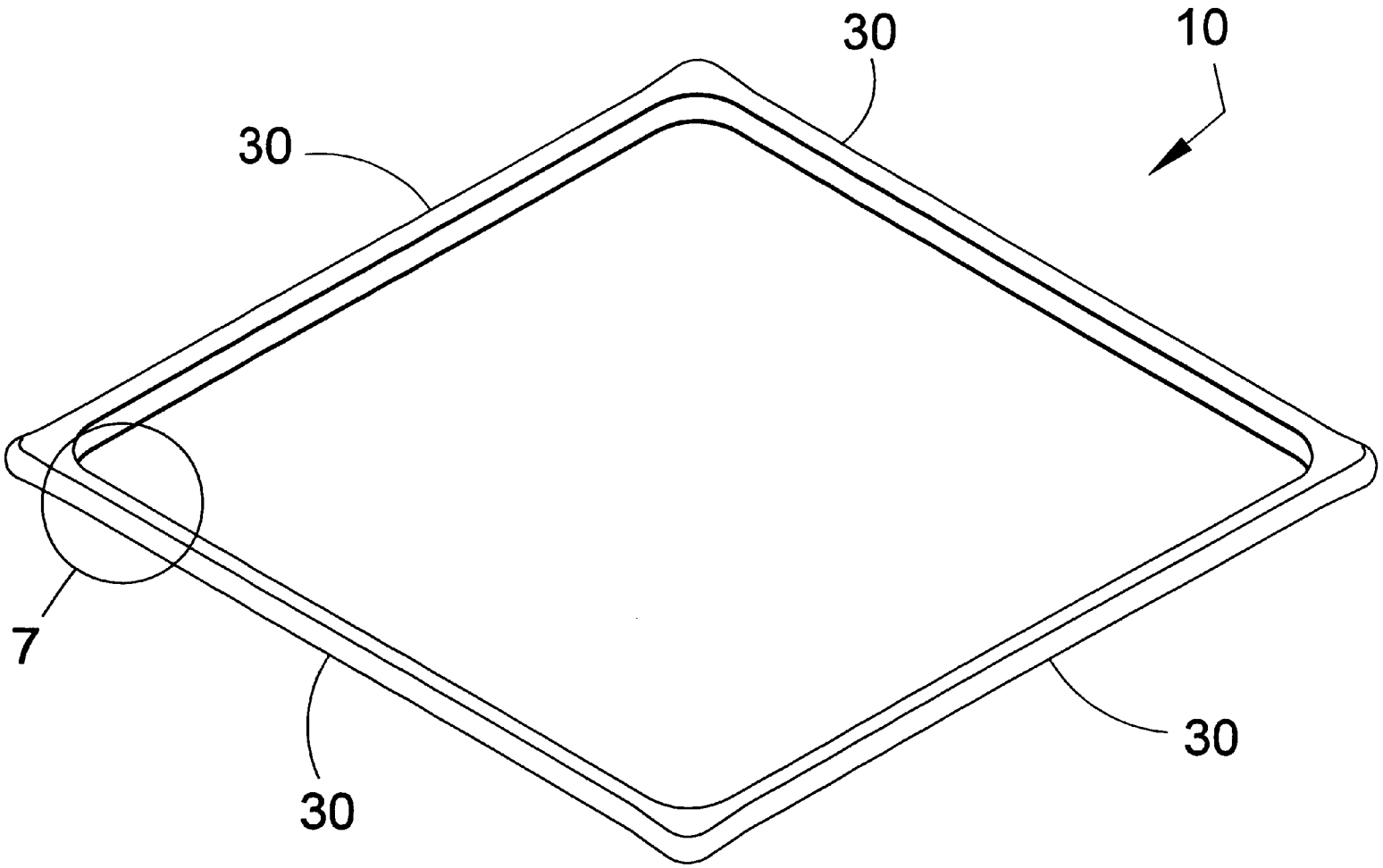
FIG. 3 is a top perspective view of the present invention, The Air-Guard Corner and Edge Protector.
Figure 4:
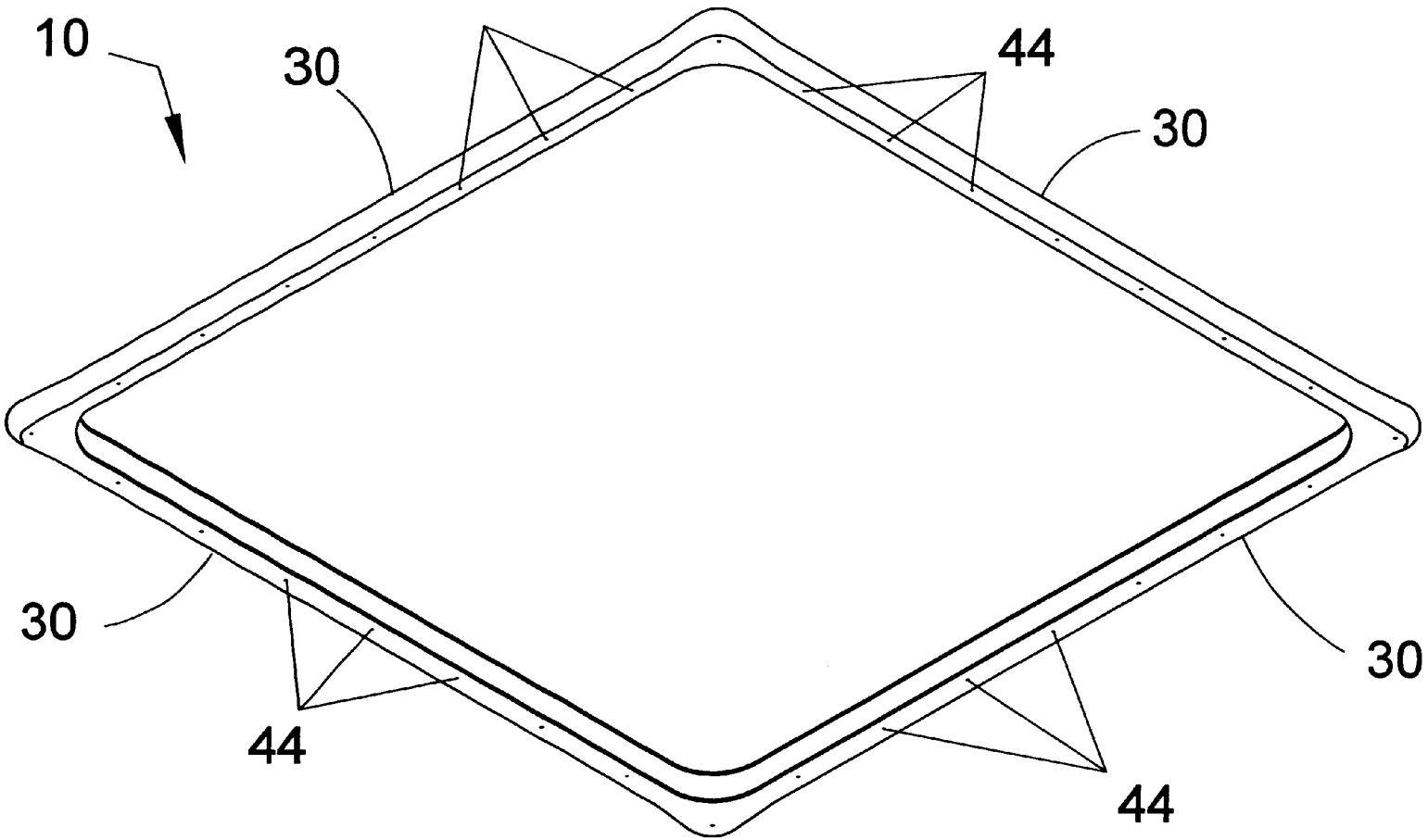
FIG. 4 is a bottom perspective view of the present invention, The Air-Guard Corner and Edge Protector, showing the bleed holes that provide pneumatically controlled collapsibility.
Figure 5:
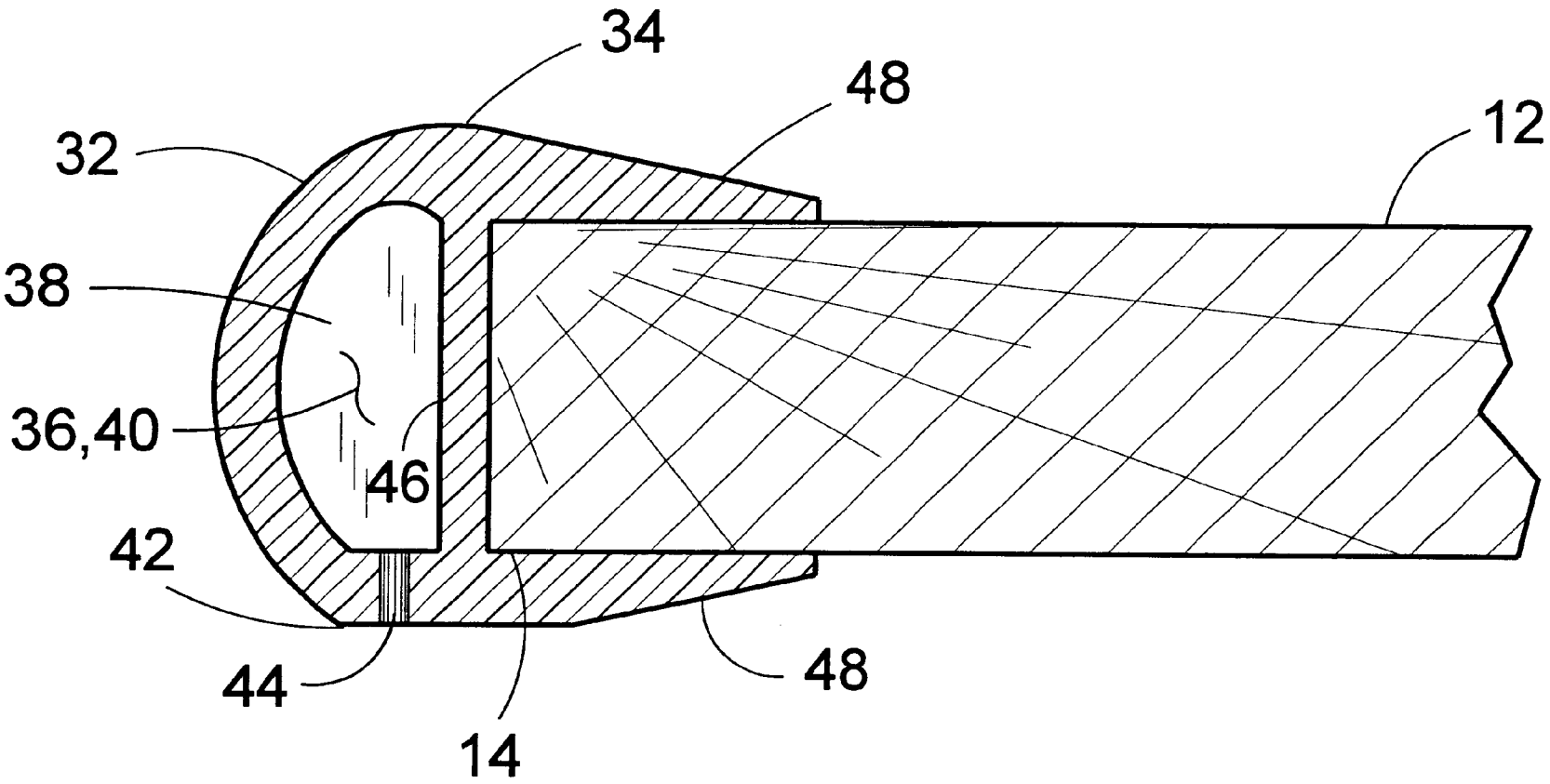
FIG. 5 is a section view of a typical non-corner cross-section of the present invention, the Air-Guard Corner and Edge Protector, showing the air chamber and tabletop gripping feature.
Figure 6:
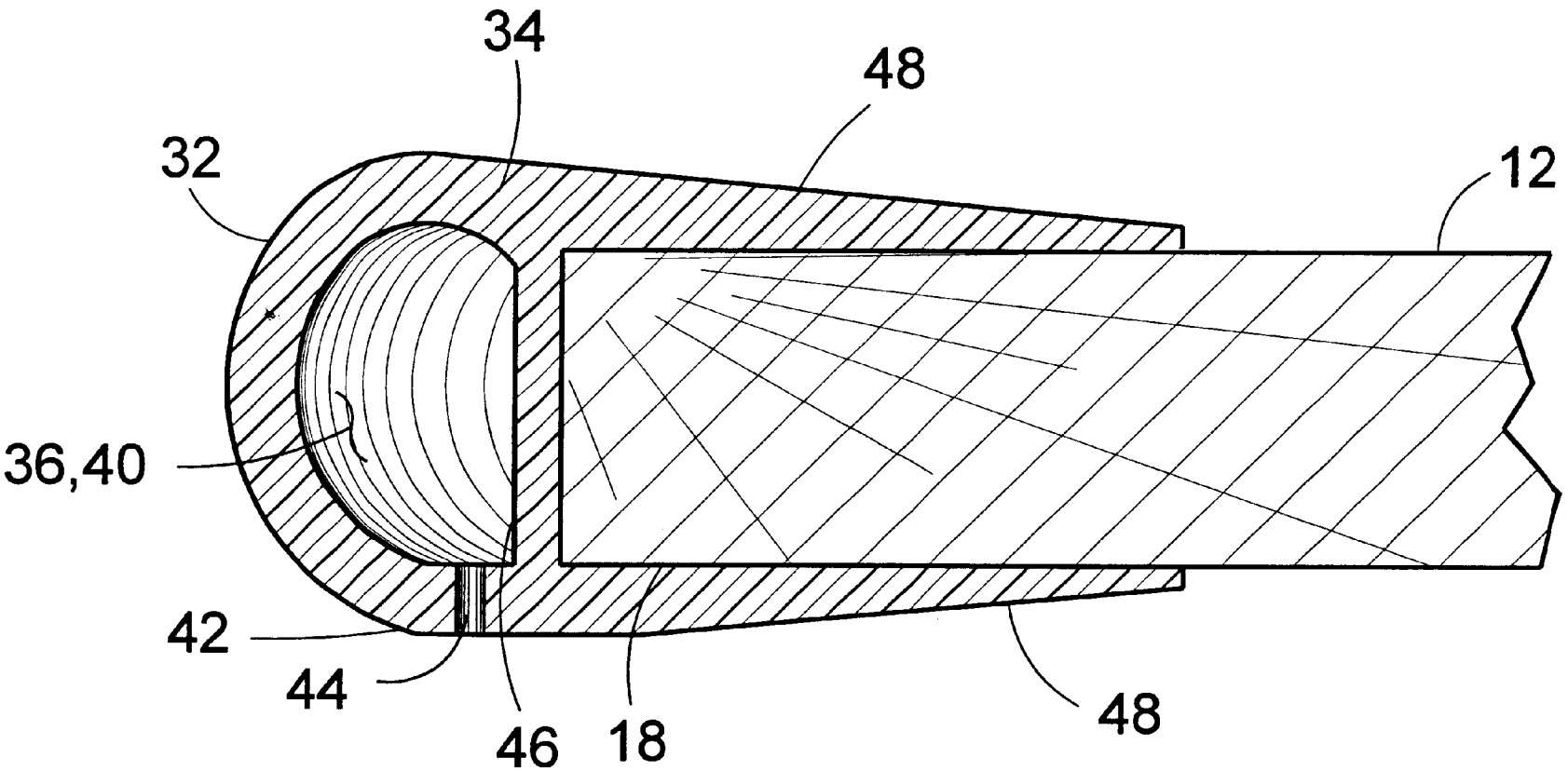
FIG. 6 is a section view of a typical corner cross-section of the present invention, the Air-Guard Corner and Edge Protector, showing the air chamber and tabletop gripping feature.
Figure 7:
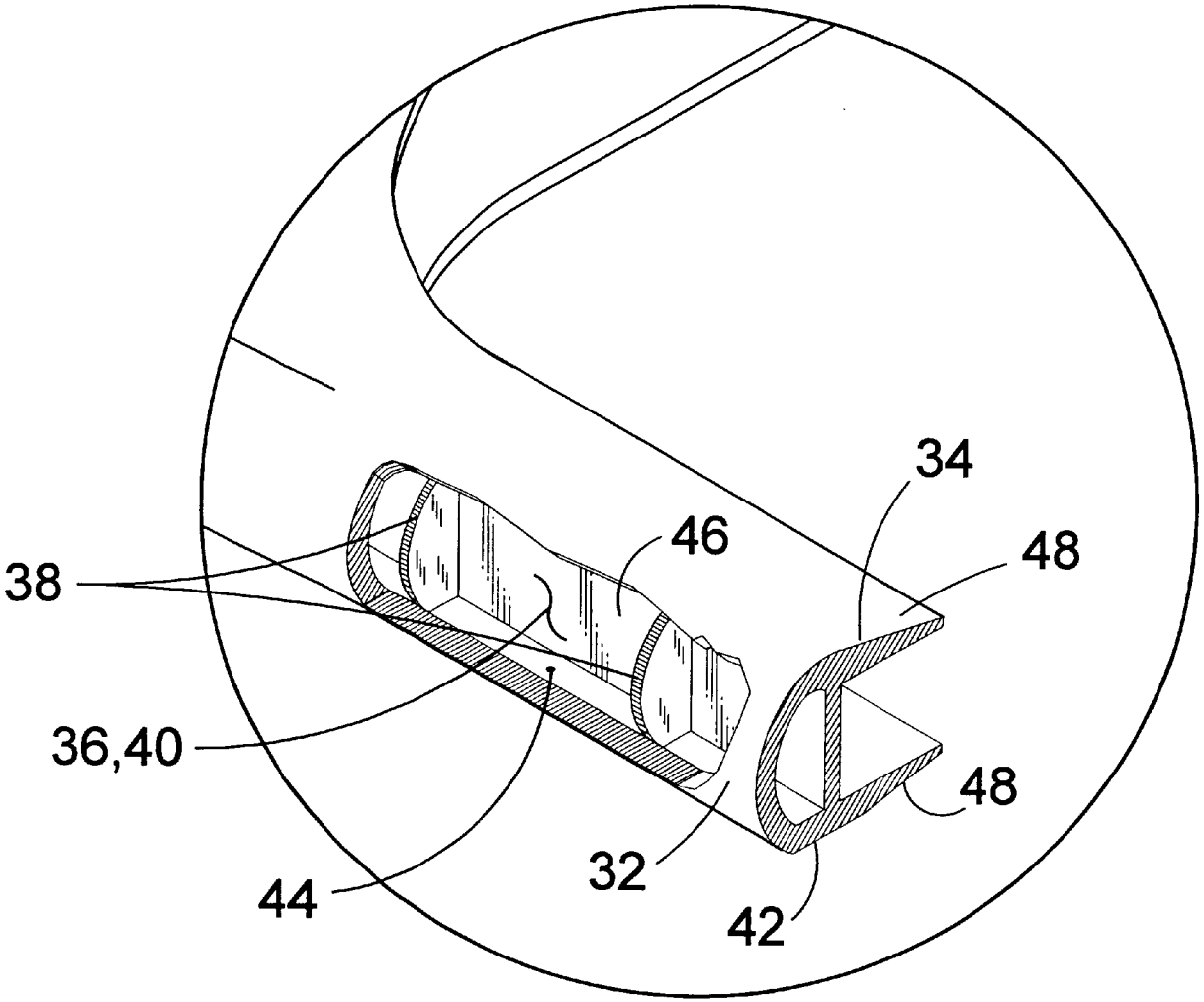
FIG. 7 is a broken-out section view of a typical non-corner or edge type portion of the present invention, the Air-Guard Corner and Edge protector, showing the interior elements of the air chamber and tabletop gripping feature.

In this embodiment, as shown in FIGS. 2–4, four elongated members 30 are joined to form the rectangular shape needed to encompass the four sides 14 and corners 18 of the table 12. As depicted in FIGS. 5–7, each elongated member 30 has an outer wall 32 joined to a rear portion 34, such that a cavity 36 is formed. Elastomeric partitions 38 are positioned such that the cavity 36 is divided into chambers 40, as shown in FIG. 7. Various lengths and joined configurations of such elongated members 30 can be chosen to accommodate the different sizes and shapes of tables and other furniture, e.g. long coffee tables, office desks, dining room tables, end tables, counter tops, circular table tops, all in accordance with the present invention, and as determined by the intended end use for the overall device, as will occur to those of skill in the art upon review of the present disclosure.

The outer wall 32 has a cavity floor portion 42, with each chamber 40 having at least one bleed hole 44 in the cavity floor portion 42. Such bleed holes 44 are the sole ports of air ingress and egress into and out of the chamber 40. In this embodiment only one bleed hole 44 is provided for each chamber 40. Using this ratio the spacing and number of the chambers 40 can be ascertained from FIG. 4.

As shown in FIGS. 5 and 6, the rear portion 34 includes the rear wall 46 and rearwardly extending portions 48, which form a notch for inserting and grasping the table edge 14. In other embodiments (not shown), extending portions similar to extending portions 48 can be attached to the table 12 using a variety of known adhesives, hook-and-pile fasteners and other common attachment devices, and other extending portion configurations can also be used, e.g. an L-shaped, or arc-shaped, configuration for square-edged and round-edged furniture having no graspable surface available, all in accordance with the present invention, and as determined by the intended end use for the overall device, as will occur to those of skill in the art upon review of the present disclosure.

When two elongated members 30 join at a table corner 18, the size of the cavity 36 is larger than along the table edges 14, as shown by comparing FIG. 5 to FIG. 6. Similarly, the thickness of the outer wall 32 is greater, and the length of the rear portion rearwardly extending portions 48 is longer at such joinders.

An embodiment (not shown) for circular tables is also provided, the ends of the elongated member 30 being joined and having a circumference such that the stretched member 30 can be placed about the round table edges and released such that the partially stretched member 30 will be snug against the table edge.

The device 10 is installed by placing the rear portion rearwardly extending portions .48 about the table edges 14 and corners 18, stretching the tensible elongated members 30 as needed to fit the device 10 about all four table edges 14. The device 10 stays in place due to either or both of the grasping tendencies of the rearwardly extending portions 48, or the tension in the elongated members 30 remaining after the device 10 is stretched into position to put the table edges 14 between the rearwardly extending portions 48. When properly sized, very little play or looseness will be, present.

Figure 8:
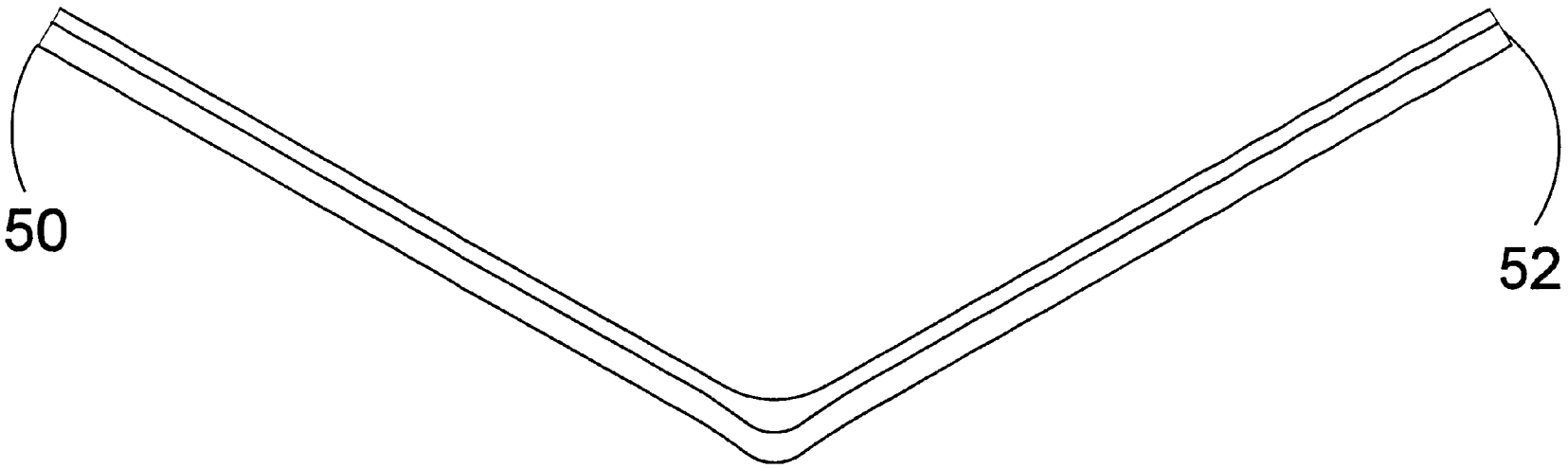
FIG. 8 is a perspective view of an embodiment for singe table corners.

The embodiment in FIG. 8 illustrates the adaptability of the device to individual table corners. In this embodiment, the first end 50 and second end 52 are closed.

In its pre-impact state, the chambers 40 are filled with air. As the head of the child 16 begins to load the device 10, two energy absorption mechanisms are in effect. The first is the compression of the elastomeric material in the outer wall 32 and possibly the partitions 38. Kinetic energy is converted to potential energy as such material is compressed. Second, the outer wall 32 is displaced into the chamber 40. Air is forced from the bleed hole 44 as the chamber 40 collapses, with the bleed hole 44 being sized such that an appropriate rate of collapse is achieved. This controlled collapsibility improves the energy absorbing capabilities of the device 10 above that of a similarly sized solid compressible material in that the pulse of the deceleration event is increased.

Furthermore, in the event of a total collapse of the chamber 40, the compression of the outer wall 32 material will resume as the outer wall 32 continues to be loaded while against the rear wall portion 46.

Once the head displacement has stopped, the head will rebound less due to the previous collapse of the chamber 40, whether a partial collapse or otherwise. Although the spring characteristics of the compressed outer wall 32 material will cause some rebound, the return of the displaced outer wall 32 to its pre-impact position is slowed by the relatively slow rate at which air returns to the chamber 40 through the bleed hole 44. Any lowering of the rebound rate is beneficial to the child 16 with regard to the potential for head injury.

It will be understood that each of the elements described above, or two or more together, may also find a useful application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An energy absorbing device for attachment to, and in combination with, the exterior features of furniture, comprising:

(a) an elongated member having;

(1) an elastomeric and generally arcuate outer wall;

(2) a rear portion, the rear portion being sized and shaped to closely receive at least one of the furniture exterior features;

(3) a cavity formed by the outer wall and the rear portion;

(4) a closed first end;

(5) a closed second end; and (6) a bleed hole, the bleed hole being positioned in the outer wall to allow air to exit and enter the cavity, the bleed hole being sized such that, when the outer wall is impacted by an object, the outer wall is elastically compressed, the outer wall also being displaced into the cavity such that the cavity is deformed by the intruding outer wall and air is expelled from the cavity through the bleed hole, and further such that, when the compression and displacement of the outer wall ceases, the outer wall expands to its original configuration, the expansion of the outer wall causing air to be drawn into the cavity through the bleed hole; and (b) a plurality of elastomeric partitions within the cavity, the partitions dividing the cavity into chambers, said bleed hole allowing air to exit and enter each of the chambers.

2. The device of claim 1, wherein the furniture exterior feature is a table top edge.

3. The device of claim 1, wherein the furniture exterior feature is a table top corner.

4. The device of claim 1, wherein the rear portion further comprises a notch.

5. The device of claim 1, wherein the rear portion further comprises a pair of rearwardly extending, opposing members, the rearwardly extending members being spaced to closely receive a furniture exterior surface.

6. The device of claim 1, wherein the rear portion is further sized and shaped to grasp the furniture exterior feature.

7. The device of claim 1, wherein the rear portion is adhesively attached to the furniture exterior feature.

8. The device of claim 1, wherein the rear portion is shaped to receive the furniture exterior feature when the exterior feature forms a corner.

9. The device of claim 1, wherein the outer wall further has a cavity floor portion, the bleed hole being positioned in the outer wall cavity portion.

10. An energy absorbing device for attachment to, and in combination with, the exterior features of furniture, comprising:

(a) a plurality of joined elongated members, the elongated members being joined such that the joined members are adjacent at least one angular shaped furniture exterior feature, each elongated member having;

(1) an elastomeric and generally arcuate outer wall;

(2) a rear portion, the rear portion being sized and shaped to closely receive the furniture exterior feature;

(3) a cavity formed by the outer wall and the rear portion;

(4) an elastomeric partition within the cavity, the partition dividing the cavity into chambers; and (5) a plurality of bleed holes, at least one bleed hole being positioned to allow air to exit and enter each cavity chamber, each bleed hole being sized such that, when the outer wall is impacted by an object, the outer wall is compressed, the outer wall also being displaced into the cavity chamber adjacent the point of impact, such that the cavity chamber is deformed by the intruding outer wall and air is expelled from the cavity chamber through the bleed hole, and further such that, when the compression and displacement of the outer wall ceases, the outer wall expands to its original configuration, the expansion of the outer wall causing air to be drawn into the cavity chamber through the bleed hole.

11. The device of claim 10, wherein the angular shaped furniture exterior feature is corner-shaped.

12. The device of claim 10, wherein the angular shaped furniture exterior feature includes the four edges of a table, the number of elongated members being four.

13. The device of claim 10, wherein the cavity is larger at the joinder of any two of the elongated members.

14. The device of claim 10, wherein each elongated member has a length, the length being elastomerically extendable.

15. The device of claim 10, wherein each elongated member has a length, the length of the elongated members being such that the elongated members must be stretched for the rear portions of each member to be positioned for receipt of furniture exterior edges adjacent such rear portions.

16. The device of claim 10, wherein the number of partitions in each elongated member is at least two.

17. The device of claim 10, wherein each rear portion further comprises a notch.

18. The device of claim 10, wherein each rear portion further comprises a pair of rearwardly extending, opposing members, the rearwardly extending members being spaced to closely receive the adjacent furniture exterior surface.

19. The device of claim 10, wherein the rear portions are further sized and shaped to grasp the adjacent furniture exterior feature.

20. The device of claim 10, wherein the rear portions are adhesively attached to the adjacent furniture exterior feature.

21. The device of claim 10, wherein the rear portions are held against the adjacent furniture exterior feature by tension in the stretched elongated members.

22. The device of claim 10, wherein the rear portions are shaped to receive the adjacent furniture exterior features when the adjacent exterior features form a corner.

23. The device of claim 10, wherein the outer wall of each elongated member further has a cavity floor portion, the bleed holes in each chamber being positioned in the outer wall cavity floor portions.

24. The device of claim 10, wherein at least one partition is compressed during impact, the at least one partition returning to its original configuration after the compression ceases.

25. An energy absorbing device for attachment to, and in combination with, furniture of the type having a circular surface, the circular surface having an edge, the device comprising:

(a) an elongated circular member, the elongated member having;

(1) an elastomeric and generally arcuate outer wall;

(2) a rear portion, the rear portion being sized and shaped to closely receive the furniture's circular surface edge, the elongated member having a circumference such that the elongated member must be stretched to position the rear portion for receipt of the furniture's circular surface edge;

(3) a cavity formed by the outer wall and the rear portion;

(4) a plurality of elastomeric partitions within the cavity, the partitions dividing the cavity into chambers; and (5) a plurality of bleed holes, at least one bleed hole being positioned to allow air to exit and enter each cavity chamber, each bleed hole being sized such that, when the outer wall is impacted by an object, the outer wall is compressed, the outer wall also being displaced into the cavity chamber adjacent the point of impact, such that the cavity chamber is deformed by the intruding outer wall and air is expelled from the cavity chamber through the bleed hole, and further such that, when the compression and displacement of the outer wall ceases, the outer wall expands to its original configuration, the expansion of the outer wall causing air to be drawn into the cavity chamber through the bleed hole.

26. An energy absorbing device for attachment to, and in combination with, the exterior features of furniture, comprising:

(a) means for positioning the device adjacent the furniture exterior feature;

(b) means for absorbing part of the energy of an impact to the device by compressing the device;

(c) means for absorbing part of the energy of the impact to the device by pneumatically collapsing the device; and (d) means for attaching the device to the furniture exterior feature such that the device is partially stretched.

* * * * *